United States Patent [19]

Rameson

[11] 4,076,227

[45] Feb. 28, 1978

[54] SELF-ALIGNING WORK HOLDING CLAMP

[75] Inventor: William W. Rameson, Santa Monica, Calif.

[73] Assignee: TRW Inc., Redondo Beach, Calif.

[21] Appl. No.: 684,992

[22] Filed: May 10, 1976

[51] Int. Cl.[2] ..... B25B 1/18

[52] U.S. Cl. ..... 269/25; 269/95; 269/238

[58] Field of Search ..... 269/27, 32, 34, 95, 269/96, 157, 160, 237, 238

[56] References Cited

U.S. PATENT DOCUMENTS

| | | | |
|---|---|---|---|
| 2,980,948 | 4/1961 | McCain | 269/95 |
| 3,542,355 | 11/1970 | Klancnik | 269/95 |

FOREIGN PATENT DOCUMENTS

| | | | |
|---|---|---|---|
| 1,159,429 | 6/1958 | France | 269/238 |

*Primary Examiner*—Robert C. Watson

*Attorney, Agent, or Firm*—Donald R. Nyhagen; John J. Connors; Benjamin DeWitt

[57] ABSTRACT

A work part resting on a work support is clamped to the work support by means of a self-aligning work holding clamp having a pair of clamp members which are pivotally mounted and operated by actuating means acting between the members in such a way that the members automatically align themselves with the work part during closure of their jaws against the part to effect clamping of the part to the support without exerting on the part a force tending to move the part relative to the support in the direction of jaw movement. The clamp jaws may be spring biased to open position and to a predetermined position relative to the support.

4 Claims, 4 Drawing Figures

SELF-ALIGNING WORK HOLDING CLAMP

BACKGROUND OF THE INVENTION

1. Field of the Invention

This invention relates generally to work clamps and more particularly to a novel self-aligning work holding clamp.

2. Prior Art

A variety of machine shop, fabrication, assembly, and other operations require clamping of work parts to a work support on which each part rests. A vast assortment of work holding clamps for this purpose have been devised.

This invention is concerned with a problem which is encountered in certain work clamping applications. The applications referred to are those in which the work parts have a particular portion, referred to herein as a gripping element, for engagement by a work holding clamp. For one reason or another, such as dimensional differences between parts, differences in the placement of the parts on the work support, or structural difference between the parts, the position of the gripping elements of the parts relative to the work support may vary slightly from part to part. This slight variation from part to part in the positions of their gripping elements presents a problem with regard to clamping of the parts to the work support.

Consider, for example, the use of a work holding clamp with a jaw fixed to the work support. Unless the gripping element of each part happens to be precisely located in firm contact with the fixed clamp jaw, closure of the clamp will either result in improper clamping of the part or in movement of the part relative to the support due to forcing of the gripping element against the fixed jaw by the closing movable jaw.

The above disadvantages of using a work holding clamp with a fixed jaw could be avoided, of course, by precise placement of each work part on the work support so that its gripping element is properly located relative to the fixed jaw. Such precise placement of each part, however, at best would be tedious and time consuming and may be impossible owing to the necessity of locating the parts relative to some other reference.

Another way of resolving the basic work clamping problem under discussion is to use a work holding clamp which is bodily adjustable relative to the work support to permit accommodation of the clamp to the work part. That is to say, this method of resolving the work clamping problem involves accommodating the variations, from part to part, in the positions of their gripping elements relative to the work support by shifting the clamp relative to the work support to the proper clamping position for each part. This solution to the problem, however, is also tedious and time consuming.

SUMMARY OF THE INVENTION

This invention provides a novel self-aligning work holding clamp for the purpose described whose clamping jaws automatically align themselves with the gripping element of each work part, and which clamp thus automatically accommodates itself to slight variations in the position of the gripping elements relative to the work support. The clamp is thus capable of properly clamping work parts to the work support, without producing on the parts forces tending to shift the parts relative to the support, even though the position of their gripping elements relative to the support may vary from part to part.

To this end, the work holding clamp has a mounting base for rigid attachment to the work support and a pair of clamp members pivotally mounted on a common pivot axis on the base. These clamp members have opposed clamping jaws and carry actuating means which act between the members to open and close the jaws by relative rotation of the members on their common pivot axis.

In operation of the clamp, closing of the jaws by the clamp actuating means with the gripping element of a work part between the jaws results in initial contact of one jaw or the other with the element and subsequent contact of the other jaw with the element to grip the latter. Being rotatable independently about a common pivot axis, the jaws automatically position themselves for proper clamping engagement with the gripping element of the part, without exerting on the part a force tending to shift the part relative to the work support.

A spring may be connected between one clamp member and the mounting base for urging this member to a normal position relative to the base, determined by an adjustable stop between the base and latter clamp member. The clamp actuating means may comprise a spring connecting the clamp members for urging the latter relative to one another in a direction to open their clamping jaws to a normal position determined by an adjustable stop between the members.

In the particular embodiment described, the clamp members are elongate clamp arms having clamping jaws at one end of the arms and pivotally mounted between their ends on the mounting base. The clamp actuating means comprises a fluid pressure actuator carried on the other end of one arm and having a plunger which is extendable by fluid pressure against the other arm to close the clamping jaws.

DESCRIPTION OF THE PREFERRED EMBODIMENTS

Figure 1:
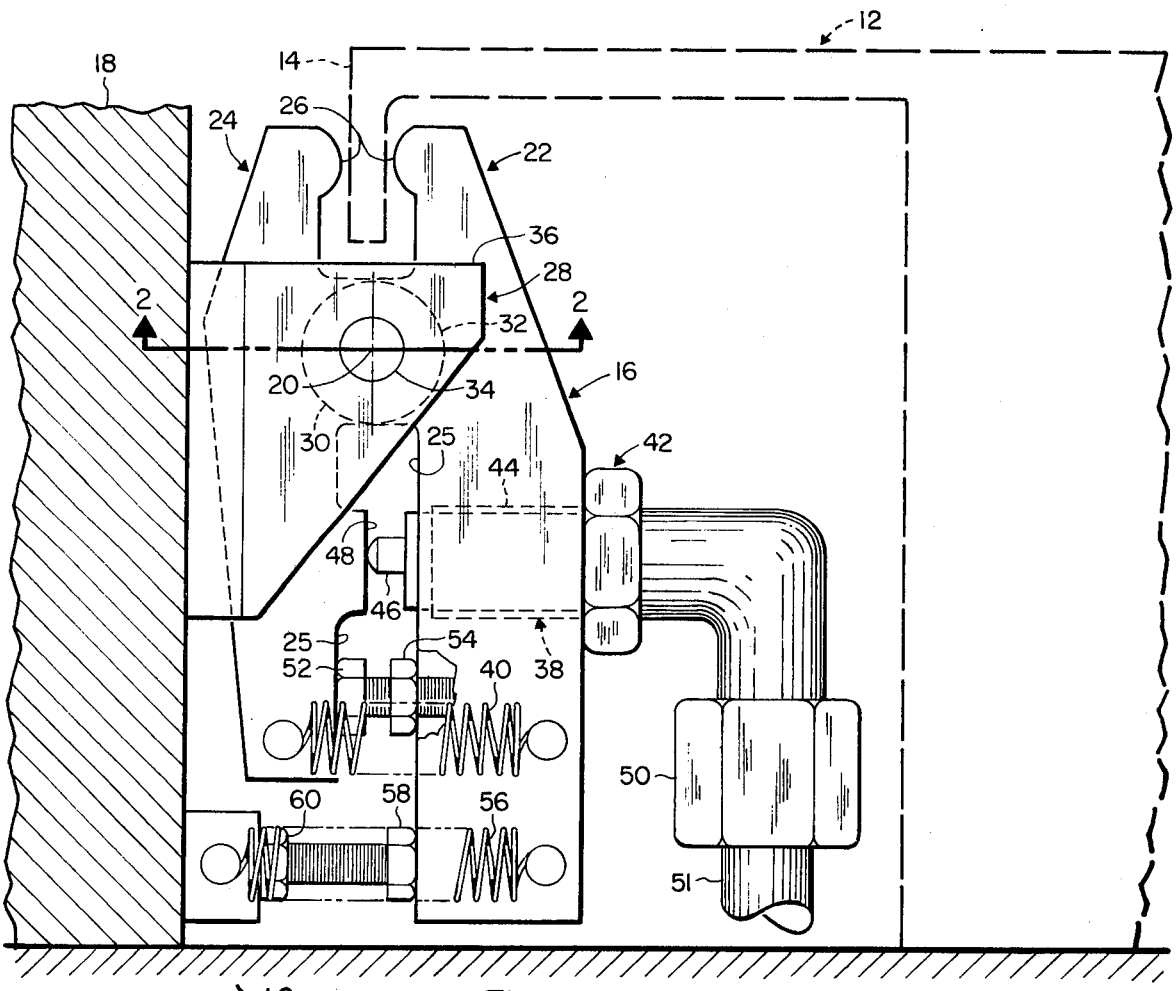
FIG. 1 is a side elevation of a work holding clamp according to the invention.
Figure 2:
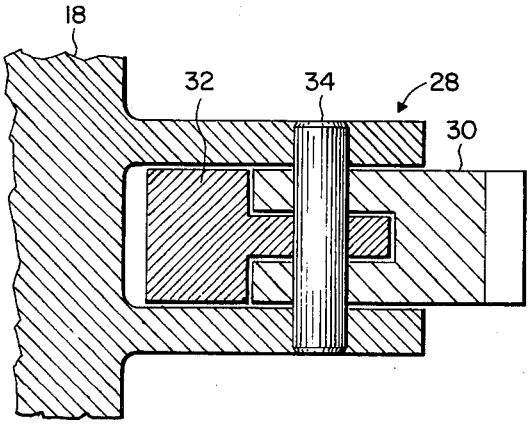
FIG. 2 is a section taken on line 2—2 in FIG. 1.
Figure 3:
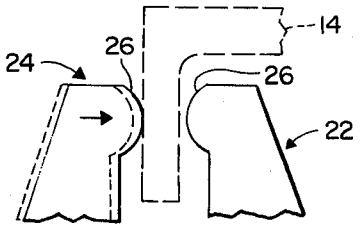
FIGS. 3 and 4 illustrate the self-aligning closing action of the clamp jaws.
Figure 4:
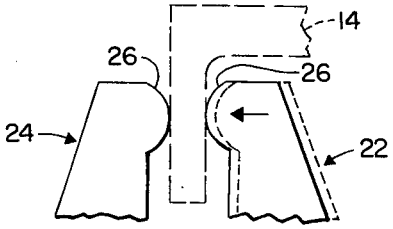

In the drawings, reference numeral 10 denotes a work support on which rests a work part 12 to be held or clamped to the support. This work part has a gripping element, in the form of a flange 14, adapted for gripping engagement by a work holding clamp for securing the part to the work support. The present invention provides a self-aligning work holding clamp 16 for this purpose.

Clamp 16 has a mounting base 18 for rigid attachment in any suitable manner to the work support 10. Pivotally mounted on a common pivot axis 20 on this base are a pair of clamp members 22, 24 in the form of opposed elongate clamp arms having confronting inner sides 25 and opposed clamping or gripping jaws 26 at one end. Clamp arms 22, 24 are pivotally mounted between their ends on the base by means 28 including a pair of spaced, parallel, generally semicircular projecting tongues 30 at the inner side 25 of arm 22 straddling a generally semicircular projecting tongue 32 at the inner side of arm 24, and a pivot pin 34 extending through these tongues, along the axis of their circularly curved edges, and through a pair of bracket flanges 36 straddling the arms and rigidly joined to the base. Thus, the clamp arms 22, 24 are rotatable together and independently about their common pivot axis.

Clamp arms 22, 24 carry clamp actuating means 38 which act between the arms to open and close their jaws 26. Operating means 38 comprise a tension spring 40 connecting the ends of the arms opposite the jaws for urging the latter arm ends together to open the jaws and force applying means 42 for exerting a spreading force between these ends to close the jaws. The particular force applying means shown is a fluid pressure actuator having a cylinder 44 threaded in arm 22 and containing a plunger 46 which is extendable against a base 48 on the inner side of arm 24 by pressure fluid entering the cylinder through an inlet fitting 50 at the outer side of arm 22 and a hose 51 opening movement of the clamp jaws 26 is limited by an adjustable limit stop in the form of a stopscrew 52 threaded in the inner side of arm 22 and mounting a jaw nut 54 for locking the screw in fixed position.

Connecting the mounting base 18 and the end of clamp arm 22 opposite its jaw 26 is a tension spring 56. This tension spring urges the arm 22 to a normal position against an adjustable limit stop in the form of a stopscrew 58 threaded in the base and mounting a jaw nut 60 for locking the screw in fixed position.

In operation of the self-aligning work holding clamp, assuming the work part gripping element or flange 14 is positioned between the jaws 26 of the clamp members or arms 22, 24, with the jaws initially in their normal full open positions, fluid under pressure is admitted to the actuator cylinder 44 through its inlet fitting 50 and base 51 to extend the actuator plunger 46 against clamp arm 24. During this plunger extension, clamp arm 22 is initially retained in its normal position by spring 40, and clamp arm 24 is rotated relative to arm 22 in a clockwise direction in FIG. 1 to close the clamp jaws 26. This rotation of clamp arm 24 continues until its jaw contacts the work part flange 14, at which point the arm becomes stationary. Continued extension of the actuator plunger after this contact rotates the clamp arm 22 counterclockwise in FIG. 1 relative to the now stationary arm 24 until its jaw 26 contacts the flange 14 to effect gripping of the flange between the two jaws. Thus, the clamp is effective to grip the flange without exerting on the flange a force tending to move the work part 12 relative to the work support 10 in the direction of closing movement of the jaws.

As noted earlier, the present work holding clamp is designed for applications in which the position of the work part gripping element or flange 14 relative to the work support 10 may vary slightly from part to part. The clamp accommodates this variation without any need for manual adjustment of the clamp relative to the work support. To this end, the clamp is located on the work support, and its jaw opening is set, by adjustment of limit stop 52, and located relative to the work support, by adjustment of limit stop 58, in a manner such that the jaw opening will receive the work part gripping flange throughout the range of positions which the flange may occupy relative to the work support. Throughout this range, the self-aligning clamp 16 is operable, in the manner described above, to grip the flange without exerting on the work part a force tending to shift the part relative to the work support.

In connection with the limit stop 58, it is evident that adjustment of this stop adjusts the clamp jaws 26 and hence the jaw opening right and left in FIG. 1 relative to the work support 10. This adjustment in conjunction with the width of the jaw opening defines the range of work part gripping flange positions which the clamp 16 will accommodate.

I claim:

1. A self-aligning work holding clamp for clamping to a work support a work part resting on the support and having a gripping element for clamping engagement by the clamp, comprising:

a mounting base to be fixed to said work support;

a pair of clamp members having opposed gripping jaws for straddling said gripping element of said work part;

means pivotally mounting said clamp members on a common pivot axis on said mounting base for initial rotation of either jaw into contact with said gripping element and following rotation of the other jaw into contact with said gripping element;

first means for yieldably biassing one clamp member to a normal position relative to said mounting base;

second means for yieldably biassing the other clamp member to a normal position relative to said one clamp member; and actuating means carried by and acting between said clamp members for relatively rotating said clamp members to open and close said jaws.

2. A self-aligning work holding clamp according to claim 1 wherein:

said first biassing means comprises a spring connecting said base and said one clamp member for urging said latter member toward its normal position relative to said base, and a limit stop for limiting rotation of said latter member by said spring; and said second biassing means comprises a spring connecting said clamp member for urging the other clamp member toward its normal position relative to said one clamp member, and a limit stop for limiting rotation of said other member by the latter spring.

3. A self-aligning work holding clamp according to claim 2 wherein:

said limit stops are adjustable to adjust the normal positions of said clamp members.

4. A self-aligning work holding clamp for clamping to a work support a work part resting on the support and having a gripping element for clamping engagement by the clamp, comprising:

a mounting base to be fixed to said work support;

a pair of clamp members having opposed gripping jaws for straddling said gripping element of said work part;

said clamp members comprising elongate clamp arms having said gripping jaws at one end of the arms;

means pivotally mounting said clamp members on a common pivot axis on said mounting base for initial rotation of either jaw into contact with said gripping element and following rotation of the other jaw into contact with said gripping element;

said pivotal mounting means comprising a pivot between the ends of said clamp arms for closing of said jaws by rotation of the other arm ends away from one another and opening of said jaws by rotation of said other arm ends toward one another;

actuating means carried by and acting between said clamp members for relatively rotating said clamp members to open and close said jaws;

said actuating means comprising a spring connecting said other clamp arm ends for urging the latter ends toward one another to open said jaws, and force applying means acting between said latter arm ends for forcibly separating the latter ends to close said jaws, said force applying means comprising a fluid pressure actuator including a cylinder carried by said other end of one clamp arm and containing a plunger extendable by fluid pressure against said other end of the other clamp arm;

a spring connecting said base and said other end of one clamp arm for urging said latter arm in one direction about said pivot axis relative to said base;

an adjustable limit stop for limiting rotation of said latter arm by the latter spring; and an adjustable limit stop on one clamp arm for limiting relative rotation of said clamp arms by said actuator spring.

* * * * *